US005290128A

United States Patent [19]

Yeargain et al.

[11] Patent Number: 5,290,128

[45] Date of Patent: Mar. 1, 1994

[54] METHOD AND APPARATUS FOR TRANSFERRING A DRILLING APPARATUS FROM A MOVABLE VESSEL TO A FIXED STRUCTURE

[75] Inventors: Charles W. Yeargain, Houston; Daniel F. McNease, Tomball, both of Tex.; Michael D. Moody, New Iberia, La.

[73] Assignee: Rowan Companies, Inc., Houston, Tex.

[21] Appl. No.: 852,487

[22] Filed: Mar. 16, 1992

Related U.S. Application Data

[63] Continuation of Ser. No. 769,336, Oct. 1, 1991, abandoned, Continuation of Ser. No. 609,927, Nov. 6, 1990, abandoned.

[51] Int. Cl.[5] ..... E02D 25/00

[52] U.S. Cl. ..... 405/209; 405/201; 405/196

[58] Field of Search ..... 405/209, 204, 203, 201, 405/196, 195.1

[56] References Cited

U.S. PATENT DOCUMENTS

| | | | |
|---|---|---|---|
| 1,894,950 | 1/1933 | Fitch . | |
| 2,489,869 | 11/1949 | Dunn . | |
| 2,644,971 | 7/1953 | Rowe . | |
| 2,934,905 | 5/1960 | Woolslayer et al. . | |
| 2,959,015 | 11/1960 | Beck . | |
| 2,997,852 | 8/1961 | Suderow . | |
| 3,011,318 | 12/1961 | Ashton . | |
| 3,033,525 | 5/1962 | Johnson . | |
| 3,150,787 | 9/1964 | Patrignani . | |
| 3,477,235 | 11/1969 | Branham et al. . | |
| 3,931,778 | 1/1976 | Miller et al. . | |
| 3,952,887 | 4/1976 | Lutz . | |
| 4,055,264 | 10/1977 | Abbott | 405/209 X |
| 4,103,503 | 8/1978 | Smith | 405/201 X |
| 4,252,469 | 2/1981 | Bught et al. | 405/204 |
| 4,729,695 | 3/1988 | Silvestri | 405/209 X |
| 4,848,967 | 7/1989 | Weyler | 405/209 X |
| 4,864,957 | 9/1989 | Edgar et al. | 405/209 X |
| 4,874,269 | 10/1989 | Dysarz | 405/204 X |
| 4,938,628 | 7/1990 | Ingle | 405/203 X |
| 4,973,198 | 11/1990 | Cox | 405/201 |

FOREIGN PATENT DOCUMENTS

| | | |
|---|---|---|
| 0094434 | 11/1983 | European Pat. Off. . |
| 0204591 | 12/1986 | European Pat. Off. . |
| 2405182 | 5/1979 | France . |
| 91209 | 5/1984 | Japan . |
| 1462775 | 1/1977 | United Kingdom . |
| 2022521 | 12/1979 | United Kingdom . |

OTHER PUBLICATIONS

Shipbuilding and Shipping Record, vol. 119, No. 19, 1972, pp. 29–30, "A New Concept for Moving Heavy Loads".

*Primary Examiner*—Randolph A. Reese
*Assistant Examiner*—J. Russell McBee
*Attorney, Agent, or Firm*—Fish & Richardson

[57] ABSTRACT

A skidbase 16 and a drilling structure 18 are adapted for transfer between a jack-up platform 12 and a fixed platform 14. The jack-up platform 12 is moved into position adjacent the fixed platform 14 and raised to a height aligned with the fixed platform 14. The skidbase 16 is then transferred onto the fixed platform 14 to provide a base on which the drilling structure 18 is next placed. The jack-up platform 12 is raised to a vertical height aligned with the skidbase 16. To ensure proper location of the top surface of the jack-up platform 12 relative to the skidbase 16, a connection means 47 automatically engages and aligns the jack-up platform 12 with the skidbase 16 so that skid rails 32, 44 located on the deck of the jack-up platform 12 and on a top surface of the skidbase 16 are positioned a precise distance apart and at the same vertical height. The drilling structure 18 is then skidded onto the skidbase 16 so that drilling operations may be performed from the fixed platform 14. The connection means 47 takes the form of a multi-dimension blade member 128 affixed to the skidbase 16. The blade member 128 progressively engages a series of guide members 122, 124 on the jack-up platform 12 and, thereby, progressively and stagewise aligns the skidbase 16 as the jack-up platform 12 is moved to its desired vertical height.

27 Claims, 8 Drawing Sheets

METHOD AND APPARATUS FOR TRANSFERRING A DRILLING APPARATUS FROM A MOVABLE VESSEL TO A FIXED STRUCTURE

This application is a continuation of Ser. No. 07/769,336, filed Oct. 1, 1991, now abandoned, which is a continuation of Ser. No. 07/609,927, filed Nov. 6, 1990, now abandoned.

BACKGROUND OF THE INVENTION

1. Field of the Invention

This invention relates generally to a method and apparatus for transferring a skidbase and a drilling structure from a movable vessel, such as a jack-up platform, to a permanent offshore structure, such as a production platform, and, more particularly, to a method and apparatus for accurately positioning the skidbase relative to the movable vessel during the transfer of the drilling structure from the jack-up platform to the production platform.

2. Description of the Related Art

It is common practice in the drilling of offshore oil wells for a fixed platform to be constructed above a promising field so that a multiplicity of wells may be drilled therefrom. Commonly, after the drilling process has been completed, the drilling portion of the platform is removed from the fixed platform and transported to another fixed platform where the same process is repeated. In this manner, the same drilling apparatus can be advantageously used on numerous fixed platforms. When the drilling apparatus is removed, the platform becomes merely a production platform, no longer having drilling capabilities, but remaining at the well site.

It may occasionally be desirable to again place the drilling apparatus on the fixed, production platform to drill additional wells into the field. Quite often, an increase in the price of oil or natural gas can make a formerly economically infeasible field attractive. Thus, the drilling apparatus is replaced on the fixed platform so that additional wells may be drilled to increase the production of oil or natural gas from the field. Further, it is sometimes desirable that the drilling apparatus be placed on the fixed, production platform so that the existing wells may be "reworked" to maintain a desired level of production.

The immense size of such movable drilling apparatus creates substantial technical difficulties in transporting the drilling apparatus and accurately locating it on the fixed platforms without exorbitant cost. At least one prior art system has been proposed that satisfactorily accomplishes these goals at an economically feasible rate.

For example, U.S. Pat. No. 4,103,503, issued Aug. 1, 1978 to Marvin L. Smith describes a method and apparatus that has been well received in the oil well drilling community.

Smith describes a system for transporting the drilling apparatus from the jack-up platform to the fixed platform in two stages. Before the transfer process begins, the jack-up platform is first positioned adjacent the fixed platform, and then the drilling apparatus is transferred in two separate pieces, a skidbase and a drilling structure.

The skidbase, which includes a bridge, is transferred to the fixed platform. The jack-up platform is then elevated to the same height as the top of the skidbase, and the bridge is connected to the jack-up platform to align skid rails on the top surface of the skidbase with skid rails on the deck of the jack-up platform. The drilling structure is then skidded across the skid rails and onto the skidbase on the fixed platform.

It should be appreciated that while the drilling apparatus is accurately described as immense, the jack-up platform must necessarily be an order of magnitude larger to properly carry the drilling apparatus. Accordingly the difficulty of accurately positioning the jack-up platform so that the bridge can be connected to the jack-up platform is readily apparent.

Smith suggests that fine adjustments to the positioning step can be performed by a releasable hydraulic cylinder that extends between the jack-up platform and the bridge. By alternately extending and retracting the hydraulic cylinder, an experienced operator can move the skidbase until it properly aligns with a pin connection on the jack-up platform.

While this process ma be successfully completed it is a manual, time consuming operation that would be better served by a system that automatically and accurately positions the skidbase at the precise location necessary for alignment between the bridge and the jack-up platform.

The present invention is directed to overcoming or at least minimizing one or more of the problems set forth above.

SUMMARY OF THE INVENTION

In one aspect of the present invention, a skidbase locking apparatus is provided for locking a skidbase to a structure. The skidbase includes a left beam assembly having a skid rail on an upper surface thereof, a right beam assembly having a skid rail on an upper surface thereof, and connecting members adapted for connecting the left and the right beam assemblies. A lock includes a left blade member attached to the left beam assembly and a right blade member attached to the right beam assembly. Each of the blade members has a substantially front face, an upper section having a first width, and a lower section having a second width. The first width is greater than the second width A left and a right guide assembly are attachable to the structure and cooperate with the left and right blade members respectively. Each of the guide assemblies include an upper guide member, a lower guide member, and a stop. The upper guide member and the lower guide member each have a base, a plurality of spaced apart lateral movement limiting shoulders connected to the base and defining a width, and a longitudinal movement limiting arm spaced from the base defining a depth. The upper guide member width and the upper guide member depth are greater than the corresponding lower guide member width and lower guide member depth respectively. The left stop and the right stop are adapted to limit the vertical movement of the left and the right blades relative to the left and the right guide assemblies. The stops are operable to support a load placed on the skid rails. The lock is operable in response to the left and the right blade members being inserted into the left and the right guide assemblies respectively with the left and right upper sections of the blades positioned in contact with the left and right upper guides and the left and right lower sections of the blades positioned in contact with the left and right lower guides to lock the skidbase to the structure.

In another aspect of the present invention, a method is provided for transferring a drilling apparatus, which includes a skidbase and a drilling structure, from a deck of a jack-up platform to a fixed platform. The method includes the steps of: positioning the jack-up platform adjacent the fixed platform; positioning the deck of the jack-up platform at about the same vertical height as a deck on the fixed platform; transferring the skidbase onto the deck of the fixed platform; raising the vertical height of the jack-up platform while maintaining the vertical height of the skidbase to displace upwardly a set of spaced apart, plural staged guide assemblies on the jack-up platform over and into engagement with a corresponding set of spaced apart, plural staged blade members on the skidbase to simultaneously cam the skidbase into longitudinal alignment with the jack-up platform, position the height of the jack-up structure in relation to the skidbase to receive the drilling structure, and lock together the skidbase to the jack-up platform to minimize relative movement therebetween; transferring the drilling structure from the jack-up platform to the fixed platform; and lowering the level of the jack-up platform while maintaining the level of the fixed platform to displace downwardly the set of guide assemblies to simultaneously unlock and disengage the guide assemblies from the blade members on the skidbase.

BRIEF DESCRIPTION OF THE DRAWINGS

Other objects and advantages of the invention will become apparent upon reading the following detailed description and upon reference to the drawings in which.

Figure 2:
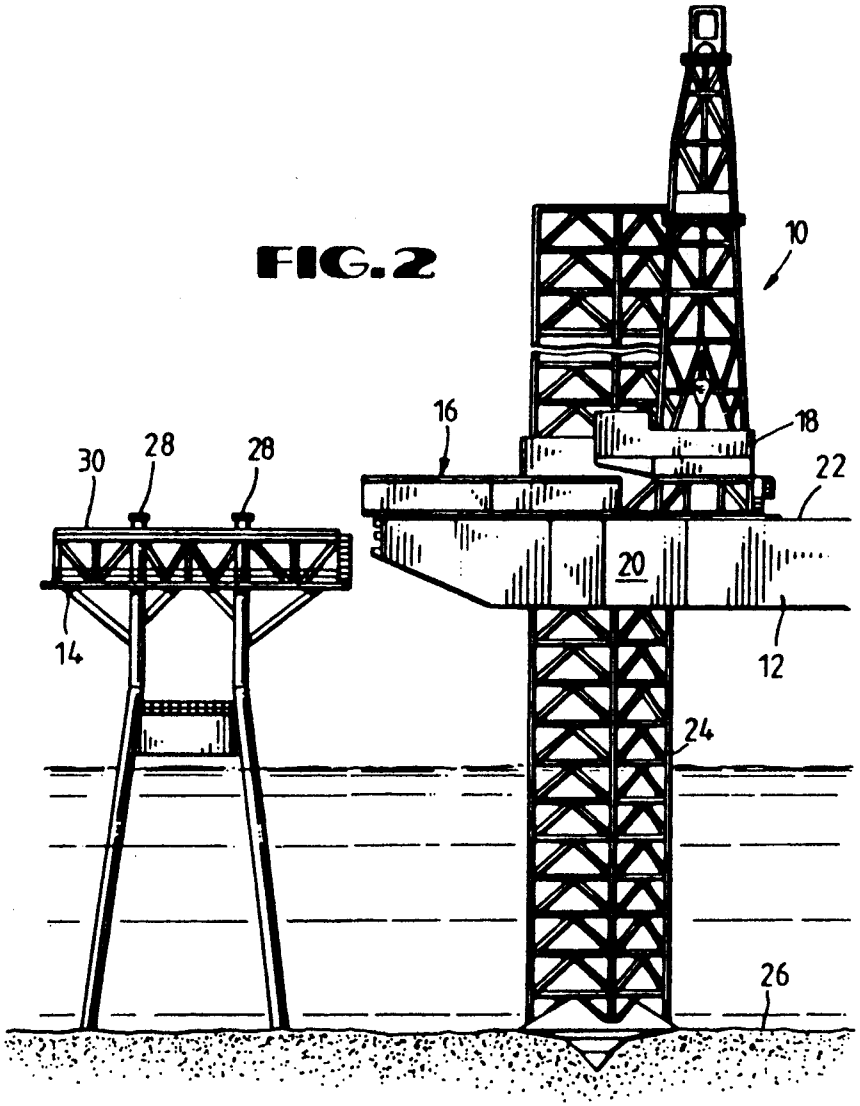
FIG. 2 illustrates the jack-up platform raised to the proper height for transferring the skidbase from the jack-up platform to the fixed, production platform.

While the system is susceptible to various modifications and alternative forms, a specific embodiment thereof has been shown by way of example in the drawings and will herein be described in detail. It should be understood, however, that this specification is not intended to limit the invention to the particular form disclosed herein, but on the contrary, the intention is to cover all modifications, equivalents, and alternatives falling within the spirit and scope of the invention, as defined by the appended claims.

DESCRIPTION OF THE PREFERRED EMBODIMENT

Referring now to the drawings and, in particular, to FIGS. 1–8, the process of transferring a drilling apparatus 10 from a jack-up platform 12 to a fixed, production platform 14 is described. Preferably, the drilling apparatus 10 is comprised of at least two separate portions and, therefore, the actual transfer process of the drilling apparatus 10 occurs in two major steps: (1) sliding a skidbase 16 from the jack-up platform 12 to the fixed, production platform 14; and (2) sliding a drilling structure 18 from the jack-up platform 12 onto the skidbase 16.

The jack-up platform 12 can take the form of any of a wide variety of such devices. It is sufficient for purposes of understanding this invention that the jack-up platform 12 be capable of two basic functions. First, the jack-up platform 12 includes a hull 20 that is sufficiently sealed against water intrusion that it is able to float on the surface of a body of water, such as the Gulf of Mexico In this manner, the jack-up platform is readily transportable to a variety of locations, and, in particular, to a location immediately adjacent the fixed platform 14.

Second, the jack-up platform 12 must necessarily include means for adjusting its deck 22 to a variety of vertical heights. Preferably, the jack-up platform 12 includes a plurality of leg members 24 that are movably connected to the deck 22 and can be raised and lowered at will. For example, when it is desired that the jack-up platform 12 be floated to a new location, the leg members 24 are raised above the sea floor 26, allowing the hull 20 to float freely on the surface of the water. On the other hand, when it is desired that the deck 22 be raised to a height substantially in line with the height of the fixed platform 14, the leg members 24 are lowered, engaging the sea floor 26 and slowly raising the height of the deck 22 to its desired level.

Raising and lowering the leg members 24 may be accomplished in any suitable manner, such as by electric, hydraulic, pneumatic, or even internal combustion motors (not shown) connected to a rack or series of racks (not shown) disposed on the leg members 24.

Figure 1:
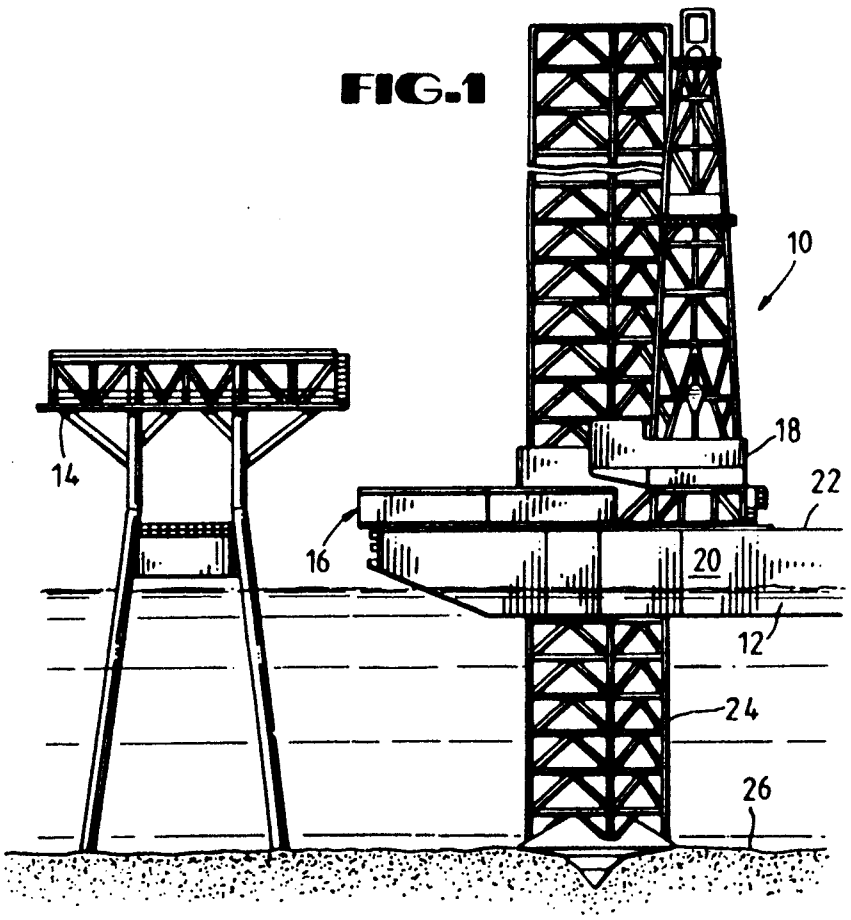
FIG. 1 illustrates a jack-up platform, which has a drilling structure and a skidbase located thereon, positioned adjacent a fixed, production platform.

FIG. 1 illustrates the jack-up platform 12 positioned immediately adjacent the fixed platform 14 with sufficient horizontal spacing therebetween to allow the deck 22 and skidbase 16 to clear the fixed platform 14 as it is raised to its proper vertical height. The leg members 24 are shown lowered to a position where the sea floor 26 is initially engaged. While only a single leg member 24 is illustrated in the drawings, it is readily understood by those skilled in the art that at least three leg members 24 are present to ensure stability of the jack-up platform 12.

FIG. 2 shows the jack-up platform 12 raised to the proper height for transferring the skidbase 16 from the jack-up platform 12 to the fixed, production platform 14. In particular, the height of the deck 22 is substantially, vertically aligned with a pair of capping beams 28, which extend across a deck portion 30 of the fixed platform 14 and are preferably positioned transverse to the major components of the skidbase 16 to provide adequate support therefor. In the event that the fixed platform 14 cannot be approached by the jack-up platform 12 from a direction that allows the skidbase 16 to be loaded transverse to the capping beams 28, then a series of beams (not shown) are secured transversely across the capping beams 28 to provide the adequate support for the skidbase 16.

Figure 3:
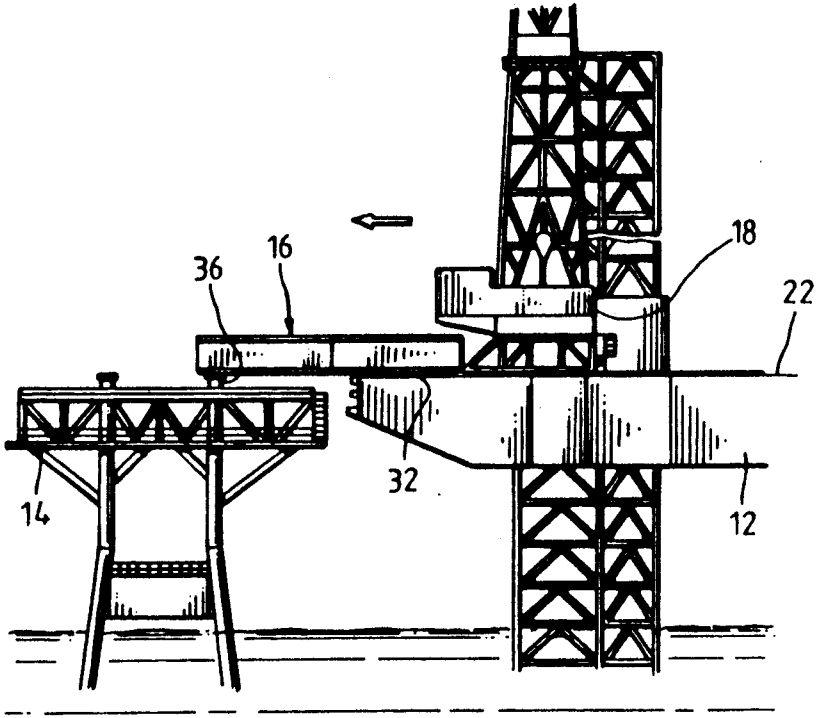
FIG. 3 illustrates the drilling structure and the skidbase being skidded toward the fixed, production platform so that the skidbase is transferred from the jack-up platform to the fixed, production platform.

FIG. 3 illustrates the skidbase 16 and drilling structure 18 being skidded toward the fixed, production platform 14 so that the skidbase 16 is transferred from the jack-up platform 12 to the fixed, production platform 14. It should be appreciated that at this time, only the skidbase 16 is actually being transferred to the fixed platform 14. The drilling structure 18 is transferred to the fixed platform 14 in a subsequent step described more fully in conjunction with the description of FIGS. 5 and 6.

The transfer process involves skidding both the skidbase 16 and the drilling structure 18 on a set of rails 32 located on the deck 22 of the jack-up platform 12. This skidding process is accomplished using power commonly available on jack-up platforms 12 of the type described herein, such as, winches and hydraulic motors (not shown).

Preferably, the skidbase 16 is attached to the drilling structure 18 via a pinned connection (see FIG. 11) so that the weight of the drilling structure 18 prevents the skidbase 16 from tilting when it is in an intermediate position, extending from the deck 22 of the jack-up platform 12 toward the first capping rail 36 but unsupported by the capping rail 36. Once the skidbase 16 has bridged the gap between the first capping rail 36 and the deck 22 of the jack-up platform 12, then the skidbase 16 is no longer cantilevered from the deck 22 and does not rely on the weight of the drilling structure 18 for support. The skidbase 16 is capable of fully supporting itself once the skidding process is substantially complete and the skidbase 16 spans the capping rails 28, as shown, for example, in FIG. 4A.

It should be noted that the skidbase 16 is composed of a support section 38 that extends between the capping rails 28 and a bridge section 40 that extends between the support section 38 and the jack-up platform 12. The bridge section 40, as is described more fully below, provides a structure on which the drilling structure 18 is moved across the gap between the jack-up and fixed platforms 12, 14 to its operating position located on the support section 38.

Figure 4A:
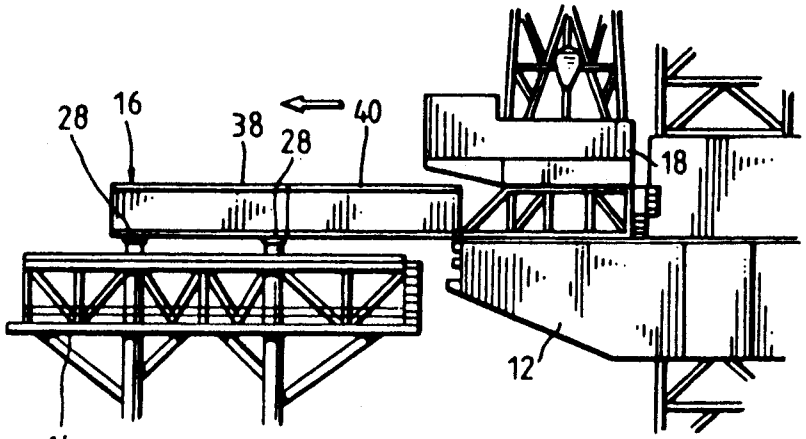
FIG. 4A illustrates the skidbase in its final position on the fixed, production platform with a bridge section of the skidbase substantially aligned with a transom of the jack-up platform.
Figure 4B:
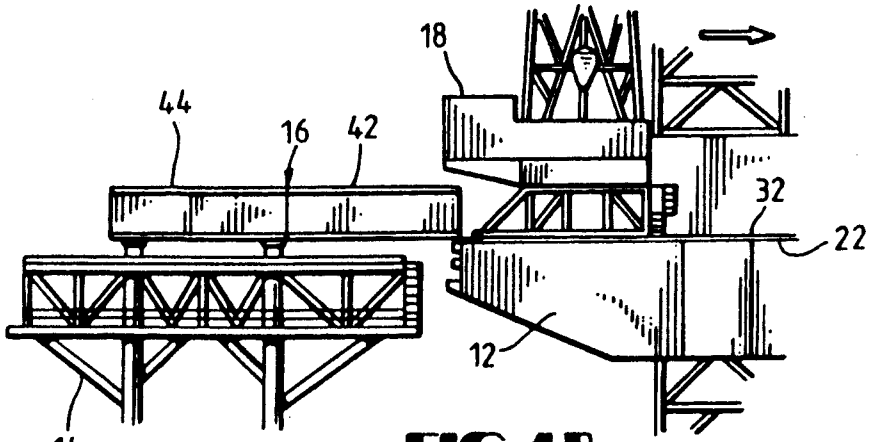
FIG. 4B illustrates the drilling structure separated from the skidbase and being moved in a direction away from the skidbase to allow the jack-up platform to be raised to a level aligned with a top surface of the skidbase.

FIG. 4B illustrates the drilling structure 18 separated from the skidbase 16 and being moved in a direction away from the skidbase 16 to allow the jack-up platform 12 to be raised to a level aligned with a top surface 42 of the skidbase 16. The top surface 42 of the skidbase 16 preferably includes a pair of rails 44 substantially identical to the rails 32 on the deck 22 of the jack-up platform 12. Thus, when the jack-up platform 12 is raised to its proper vertical height to allow transfer of the drilling structure 18 to the skidbase 16, the rails 44 on the skidbase 16 are substantially identically aligned with the rails 32 on the jack-up platform 12.

Figure 5:
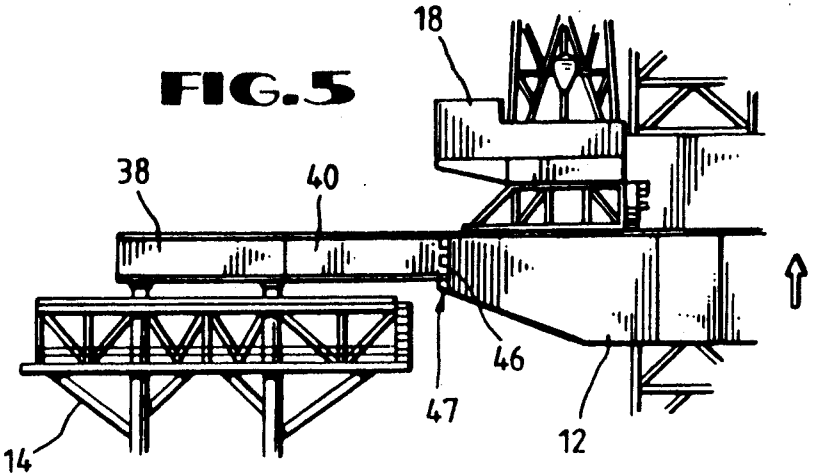
FIG. 5 illustrates the jack-up platform raised to the appropriate height for transferring the drilling structure onto the skidbase with the transom of the jack-up platform being connected to the bridge section of the skidbase.

Referring now to FIG. 5, the jack-up platform 12 is shown raised to a vertical height in line with the skidbase 16. A transom 46 of the jack-up platform 12 is shown interlocked with the bridge section 40 of the skidbase 16 via a connection means 47. The connection means 47 between the bridge section 40 and the transom 46 is configured to automatically align and accurately connect the bridge section 40 to the transom 46 without the need for pins or other external devices to accomplish accurate alignment. A better appreciation of the operation and construction of the connection means 47 may be had by reference to FIGS. 13–19, discussed below.

Figure 6:
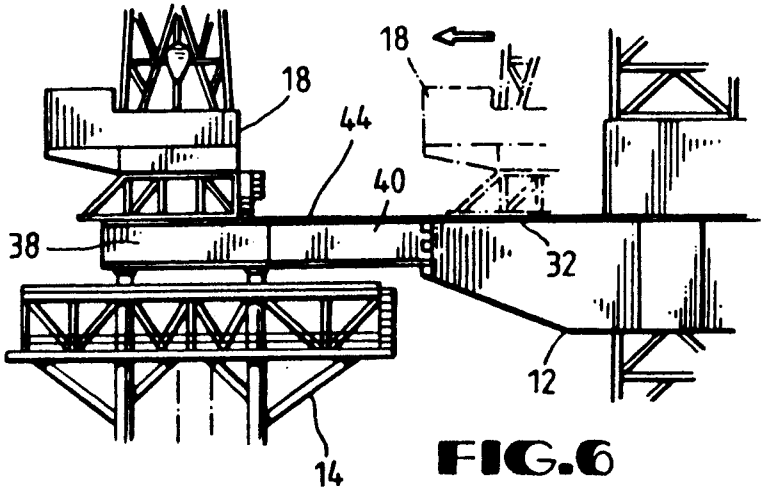
FIG. 6 illustrates the drilling structure being transferred across the bridge section and onto the skidbase.

With the rails 32, 44 substantially aligned, the drilling structure 18 is skidded from the jack-up platform 12, across the bridge section 40 and onto the support structure 38 so that additional drilling operations may be performed from the fixed, production platform 14, as shown in FIG. 6.

Figure 7:
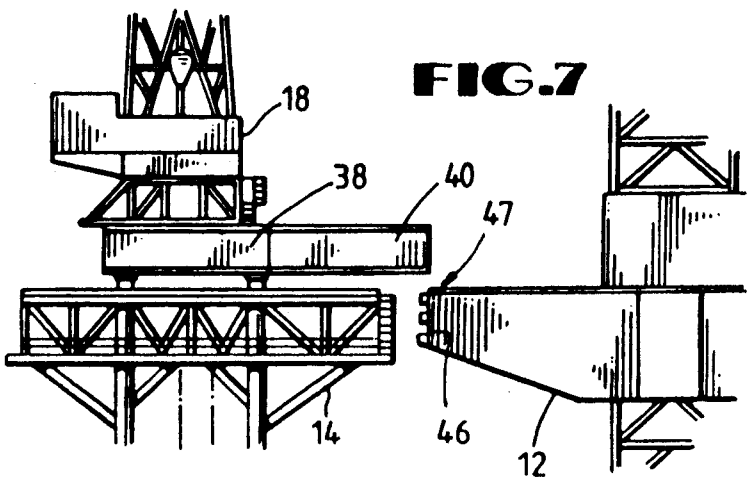
FIG. 7 illustrates the jack-up platform separated from the bridge section and lowered.

Once transfer of the drilling structure 18 is complete, the jack-up platform 12 may be lowered to the position illustrated in FIG. 7. A temporary deck 45 (FIG. 8) is preferably assembled over a slot in the jack-up platform in a manner known to persons skill in the art. From this relative position of the jack-up platform 12 and the fixed platform 14, the transfer of additional drilling materials from the jack-up platform 12 to the fixed platform 14 is facilitated. Preferably, the connection means 47 automatically releases the interconnection between the jack-up platform 12 and the bridge section 40 so that the jack-up platform 12 is free to be lowered to any desired position to facilitate material transfer.

Figure 8:
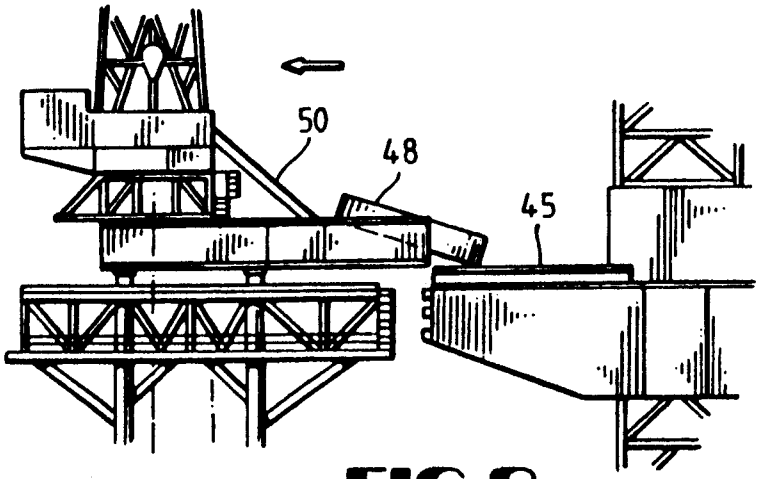
FIG. 8 illustrates the final rigging of the drilling structure, including a deck assembled over a slot in the jack-up platform, and a pipe rack extending between the jack-up platform deck and the fixed, production platform.

FIG. 8 shows a pipe rack 48 which extends between the temporary deck 45 of the jack-up platform 12 and the drilling structure 18 now positioned on the fixed platform 14. The pipe rack 48 is situated at an angle, which is a function of the height differential between the jack-up platform 12 and the skidbase 16. The inclination of the pipe rack 48 encourages the transfer of drilling pipe 50 from a substantially horizontal position on or near the temporary deck 45 of the jack-up platform 12 to a vertical position in which it is used on the fixed platform 14. The drilling pipe 50, of course, is threaded together to form a hollow core cylinder to which a drill bit (not shown) is attached and passed vertically into a well-bore (not shown) at the sea floor 26.

At this time, the transfer of the entire drilling apparatus 10 is substantially complete. However, for a proper appreciation of the advantages and operation of the instant invention, reference should be had to the preferred configuration of the skidbase 16, and, in particular, to the automatic connection means 47 between the bridge section 40 and the transom 46 of the jack-up platform 12.

Figure 9:
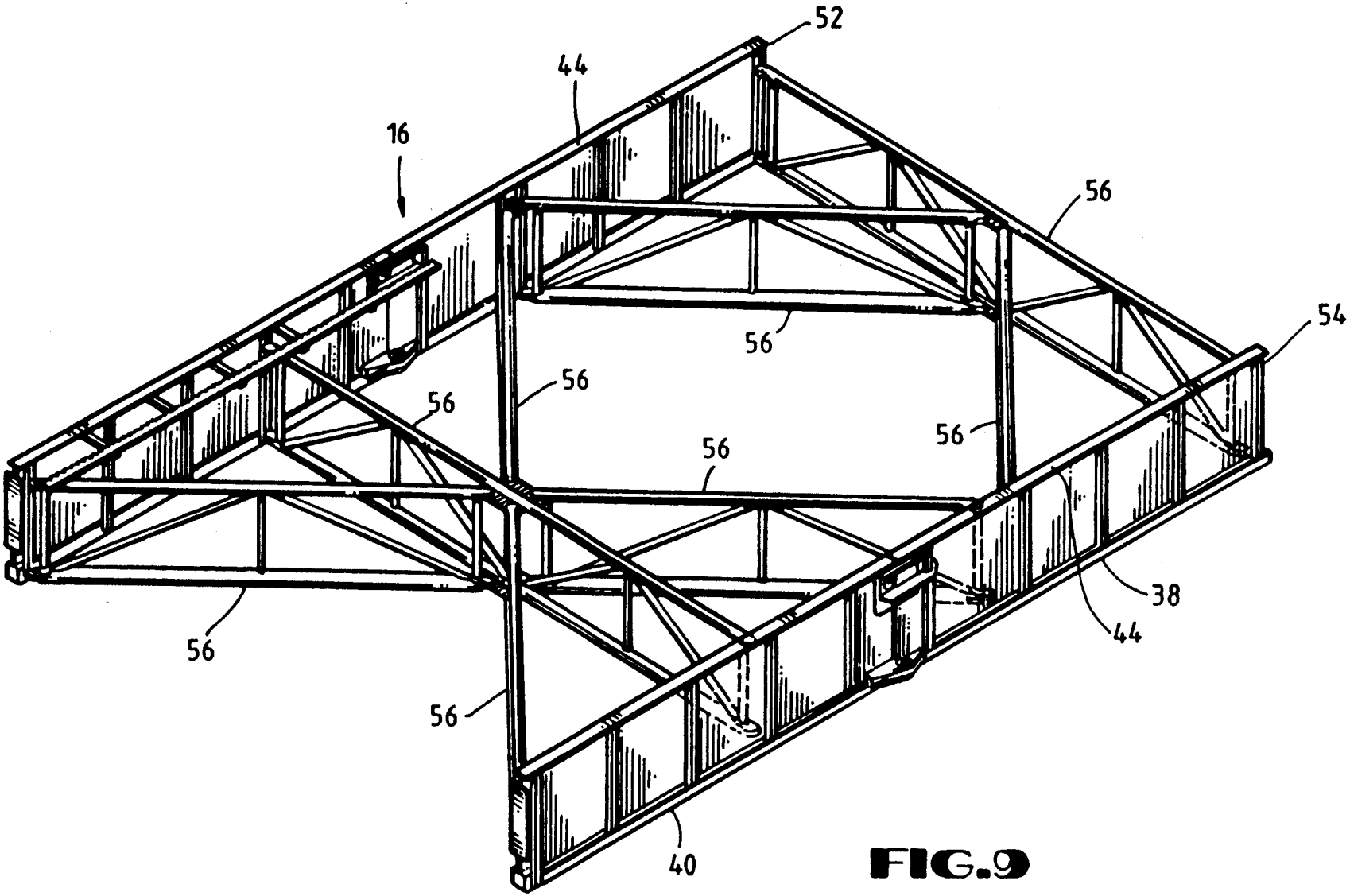
FIG. 9 illustrates a perspective view of the skidbase.
Figure 10:
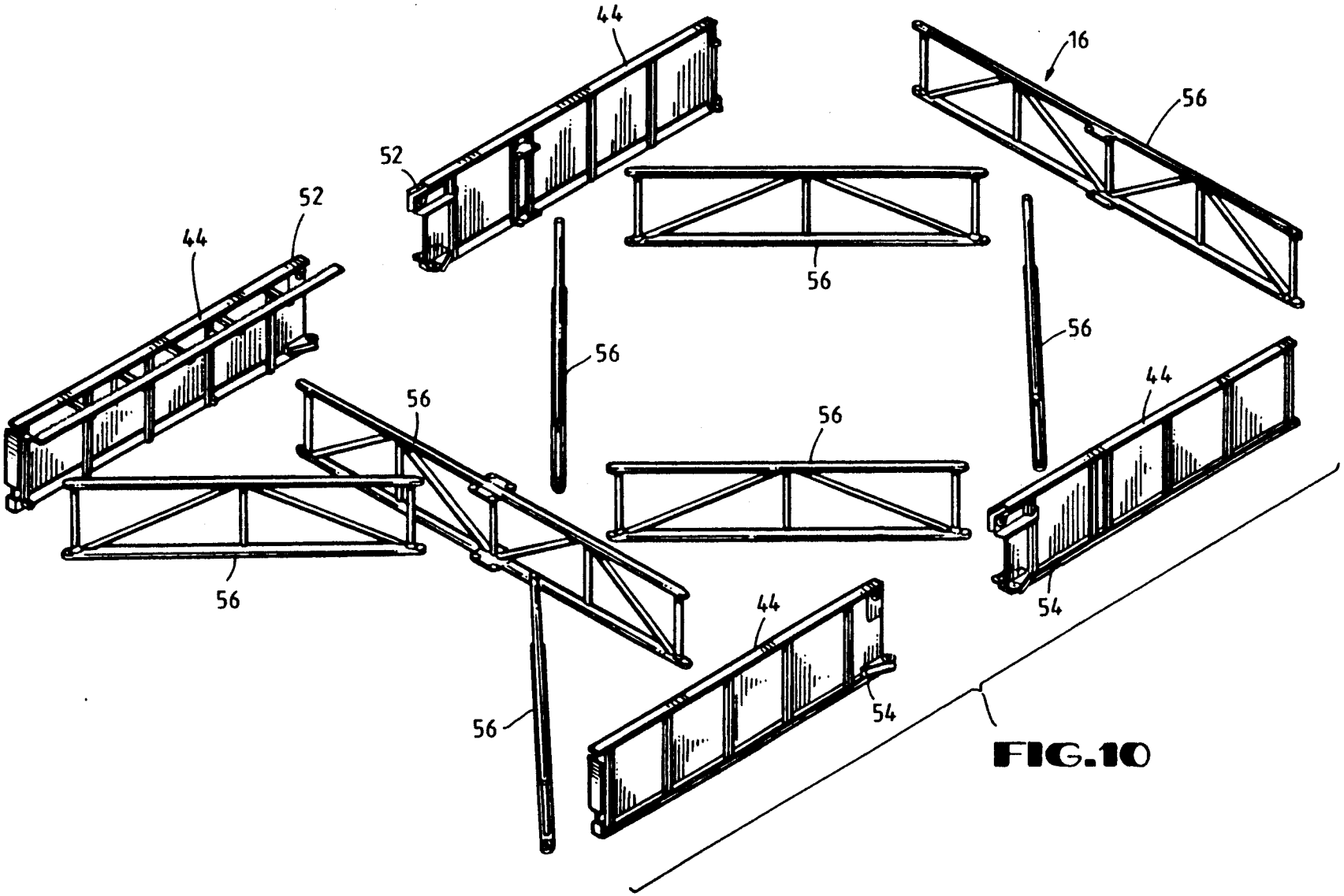
FIG. 10 illustrates an exploded perspective view of the skidbase.

Thus, turning now to FIGS. 9 and 10, the skidbase 16 is illustrated in greater detail and is shown in an assembled and exploded, perspective view respectively. The skidbase 16 includes a pair of parallel, spaced-apart beams 52, 54. The beams 52, 54 are interconnected by a plurality of open trusses 56 extending therebetween, as is more apparent from the exploded view of the skidbase 16 shown in FIG. 10. The open trusses 56 are designed to support the beams 52, 54 in their substantially upright position, and when connected together, cause the skidbase 16 to act as a substantially integral unit. Preferably, the open trusses 56 and beams 52, 54 are assembled together by a plurality of pin and eye arrangements similar to those described below in conjunction with FIGS. 11 and 12.

The skid rails 44 are formed on an upper surface of each of the beams 52, 54. It should be remembered that the skid rails 44 are used to transport the drilling structure 18 from the deck 22 into its desired position on the support section 38 of the skidbase 16.

Figure 11:
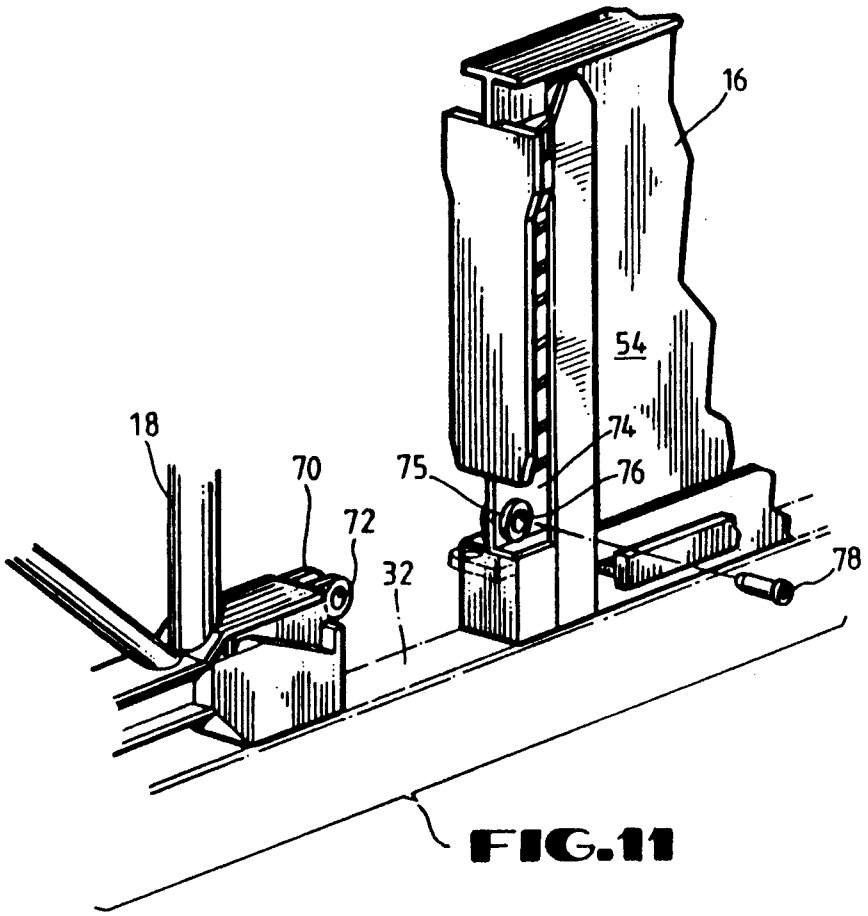
FIG. 11 illustrates a perspective view of part of the connection between the drilling structure and the skidbase.

The connection between the drilling structure 18 and the skidbase 16 is illustrated in FIG. 11. While only the connection to the beam 54 is illustrated, those skilled in the art readily recognize that the connection to the beam 5 is substantially similar. The drilling structure 18 and skidbase 16 are shown resting on the skid rail 32 on the deck 22 of the jack-up platform 12. Since this connection is not permanent and, in fact, is used only during the transfer of the skidbase 16 from the jack-up platform 12 to the fixed platform 14, the connection between the skidbase 16 and the drilling structure 18 is necessarily temporary.

For example, the drilling structure 18 includes a vertically arranged bifurcated flange 70 with a bore 72 extending perpendicularly therethrough. A tab section 74 on the beam 54 of the skidbase 16 has a perforated boss 75 with a width substantially similar to the spacing in the bifurcated flange 70. Thus, the bifurcated flange 70 extends about and encompasses the perforated boss 75 on the tab section 74 of the beam 54. A perforation or eye 76 extends through the tab section 74 and is generally aligned with eyes 72 in the bifurcated flange 70. A pin 78 is insertable through the eyes 72, 76 and can thereby temporarily interlock the beam 54 with the drilling structure 18. It should be appreciated that the pin 78 is readily removable between the stages illustrated in FIGS. 4A and 4B to allow the drilling structure 18 to be skidded a short distance away from the skidbase 16. This short skidding process provides clearance for the jack-up platform 12 to be raised level with the top of the skidbase 16.

Figure 12:
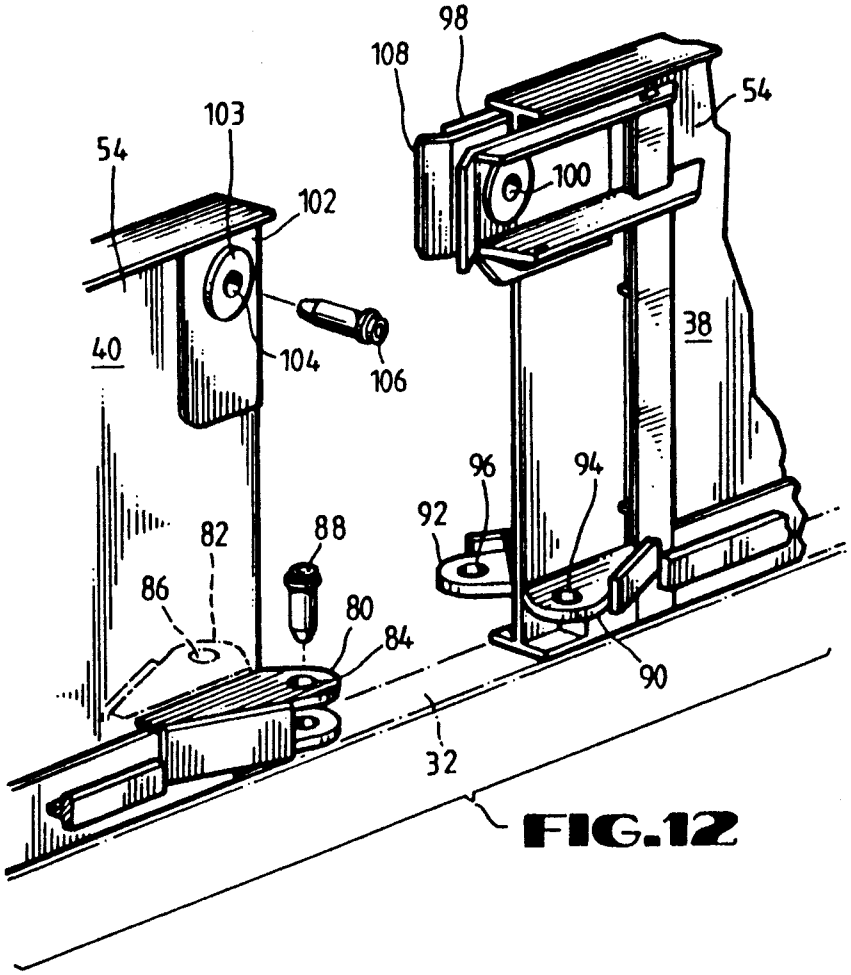
FIG. 12 illustrates a perspective view of the connection between the bridge section and the skidbase.

As is apparent from FIGS. 9 and 10, the beams 52, 54 are of a two piece construction, defining the support structure 38 and the bridge section 40 of the skidbase 16. Connection of the bridge and support sections 40, 38 of the beam 54 is illustrated in FIG. 12. It should be appreciated that the connection between the bridge and support sections 40, 38 receives a very high loading force during the transfer of the drilling section 18 thereacross. In some cases the capping rails 28 may fully support the support section 38, and the bridge section 40 will be supported only at its connections with the support section 38 and the transom 46 of the jack-up platform 12.

The bridge section 40 includes a pair of bifurcated flanges 80, 82 extending horizontally from opposite sides of a beam 54 of the bridge section 40. Each of the pair of bifurcated flanges 80, 82 includes a vertical eye 84, 86 extending therethrough and adapted for receiving a connection pin 88 therein. The support section 38 includes a pair of single perforated flanges 90, 92 extending horizontally therefrom and spaced above the skid rail 32 a distance sufficient to allow the single flanges 90, 92 to slide into the spaces in the bifurcated flanges 80, 82. The single flanges 90, 92 have corresponding eyes 94, 96 extending vertically therethrough and aligning with the boreholes 84, 86 so that the pin 88 is insertable therethrough to capture the bridge and support sections 40, 38 against relative movement therebetween.

This first pinned location is located adjacent a lower surface of the bridge and support sections 40, 38. Thus to further enhance the stability of the skidbase 16 and to prevent pivotal movement between the bridge and support sections 40, 38, a second pinned connection is located adjacent an upper edge of the beam 54. The support section 38 includes a vertically arranged bifurcated flange 98 with a horizontal eye 100 extending therethrough. The bridge section 40 includes a tab section 102 having a perforated boss 103 with a width substantially similar to the spacing in the bifurcated flange 98. The eye 104 extends through the tab section 102 and is substantially alignable with the eye 100 so that a pin 106 can be inserted therethrough and capture the bridge and support sections 40, 38 against relative movement therebetween.

To assist in aligning the bridge and support sections 40, 38 of the beams 52, 54, the bifurcated flange 98 includes a tapered section 108 at its distal end so that the spacing in the bifurcated flanges 98 is increased at its distal end. This increased width ensures that a slightly misaligned tab section 104 will be guided into the bifurcated flange 98 as the bridge and support sections 40, 38 are moved toward one another. Similarly, the bifurcated and single flanges 80, 82, 90, 92 are also tapered inward to enhance alignment of the bridge and support sections 40, 38.

Referring now to FIGS. 13–18, the automatic connection means 47 between the transom 46 of the jack-up platform 12 and the bridge section 40 of the skidbase 16 is described in greater detail.

Figure 13:
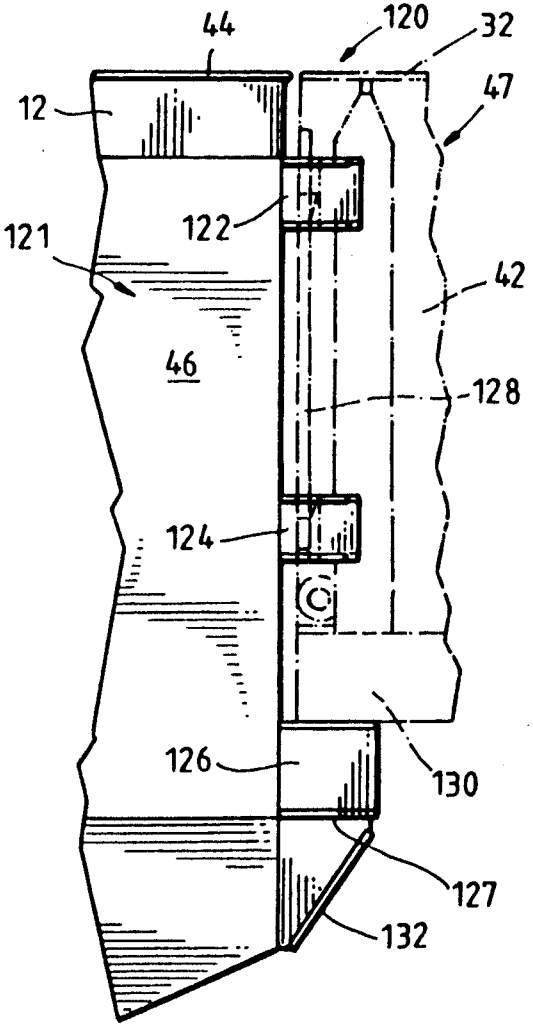
FIG. 13 illustrates a side view of the connection between the jack-up platform and the bridge section, including a lock formed from a blade member and a guide assembly.

FIG. 13 illustrates a side view of part of the transom 46 of the jack-up platform 12. The bridge section 40 is shown in phantom lines, interacting with the transom 46 to form the connection means 47. The connection means 47 includes a lock mechanism 120, which is comprised of three major components: a guide assembly 121, a stop 126, and a blade member 128. The guide assembly 121 takes the form of an upper and lower guide 122, 124, Which, along with and the stop 126, are fixedly connected to the transom 46. The blade member 128 is fixedly connected to the bridge section 40 and, in the locked position, is captured within the guides 122, 124. The bridge section 40 rests on and is supported by the stop 126.

As discussed in conjunction with FIGS. 4B and 5, the connection means 47 operates during movement of the transom 46 in a generally upward vertical direction while the bridge section 40 remains substantially stationary. Therefore, it should be appreciated that the blade member 128 remains substantially stationary as the transom 46 and guide members 122, 124 are raised into contact with the blade member 128. The blade member 128 passes through the upper and lower guide members 122, 124 as the transom 46 moves upward until a lower section 130 of the bridge section 40 contacts the stop 126. The guide members 122, 124 do not directly support the weight of the bridge 40, but rather, guide the blade member 128 and, accordingly, the bridge 40 into proper orientation so that the skid rails 44, 32 are vertically aligned and spaced a preselected horizontal distance apart.

The stop 126, on the other hand, supports the weight of the bridge 40 and the drilling structure 18 as it passes thereacross. Accordingly, the stop 126 is securely fastened to the transom 46 by any suitable means, such as, welding, threaded nut connection, or integral construction therewith. Further, a support bracket 132 preferably extends between the transom 46 and a lower surface 127 of the stop 126 to enhance its load carrying capabilities.

The guide members 122, 124 and the blade member 128 are designed to guide the bridge section 40 into its proper orientation in two stages. The bridge section 42 is first roughly aligned by interaction between the blade 128 and the upper guide member 122. Thereafter, as the transom 46 continues to rise vertically, the lower guide member 124 engages the blade member 128 and provides a second, finer stage of alignment. This finer, second stage of alignment is enhanced by further interaction between the blade member 128 and the upper guide member 122.

Figure 14:
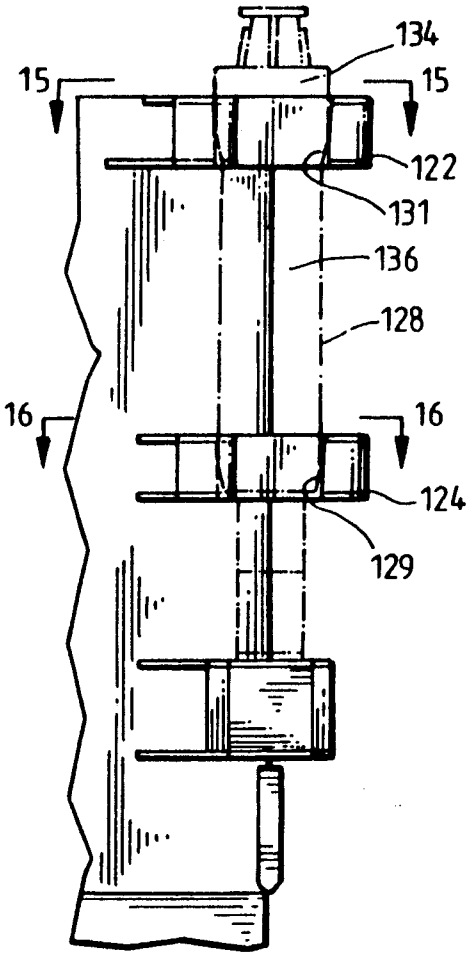
FIG. 14 illustrates an end view of the lock, with the blade member shown in phantom within the guide assembly.

As can be seen more clearly in FIG. 14, the blade member 128 has an upper section 134 and a lower section 136 of substantially different width. The widths of the upper and lower sections 134, 136 correspond to the different widths of the upper and lower guide members 122, 124. Thus, as lower section 136 of the blade member 128 enters the upper guide member 122, it has a substantially narrower width than the width of the upper guide member 122. Thus, any severe misalignment of the blade member 128 relative to the upper guide member 122 is corrected by engagement therebetween.

However, since the blade member 128 is substantially narrower than the upper guide member 122, complete alignment between the bridge section 40 and the transom 46 is not yet accomplished. Rather, as the transom 46 continues to rise, the lower guide member 124 engages the lower section 136 of the blade member 128 to further align the bridge section 40 relative to the transom 46.

Further, the distance between the lowest portions of the upper and lower section 134, 136 generally corresponds to the distance between the upper and lower guide members 122, 124. Thus, as the lower section 136 of the blade member 128 engages the lower member 124, the upper section 134 of the blade member 128 similarly engages the upper guide member 122.

To ensure gradual, even correction to the position of the bridge 40, the blade member 128 is preferably tapered in an initial section or distal end 129 adjacent its lower section 136 and at the interface or intermediate section 131 between the upper and lower sections 134, 136. Likewise, the width of the guide members 122, 124 are also preferably tapered top to bottom.

Figure 15:
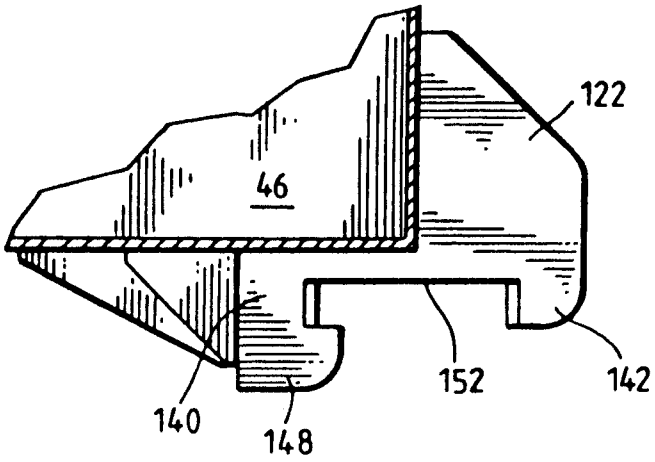
FIG. 15 illustrates a top view of an upper guide member of the guide assembly.
Figure 16:
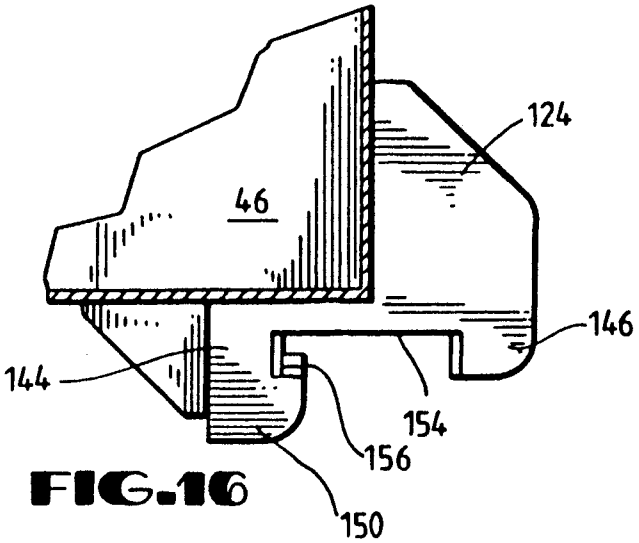
FIG. 16 illustrates a top view of a lower guide member of the guide assembly.

Top views of the upper and lower guide members 122, 124 are shown in FIGS. 15 and 16 respectively. The upper and lower guide members 122, 124 are substantially similar in construction. Each of the guide members 122, 124 includes a pair of spaced apart, lateral movement limiting shoulders 140, 142; 144, 146, which define a width that corresponds respectively to the upper and lower section 134, 136 of the blade member 128. Further, each of the guide members 122, 124 also includes a longitudinal movement limiting arm 148, 150 spaced from a base surface 152, 154. The arms 148, 150 capture the blade member 128 against horizontal movement away from the transom 46. Further, the arms 148, 150 have associated therewith, cam surfaces (see FIGS. 17–19), which urge the blade member 128 and the skidbase 16 toward the transom 46 for a precise alignment. A cam surface 156 associated With the lower guide member 124 can be seen attached to the arm 150 and extending into the space between the base 154 and the arm 150.

Figure 17:
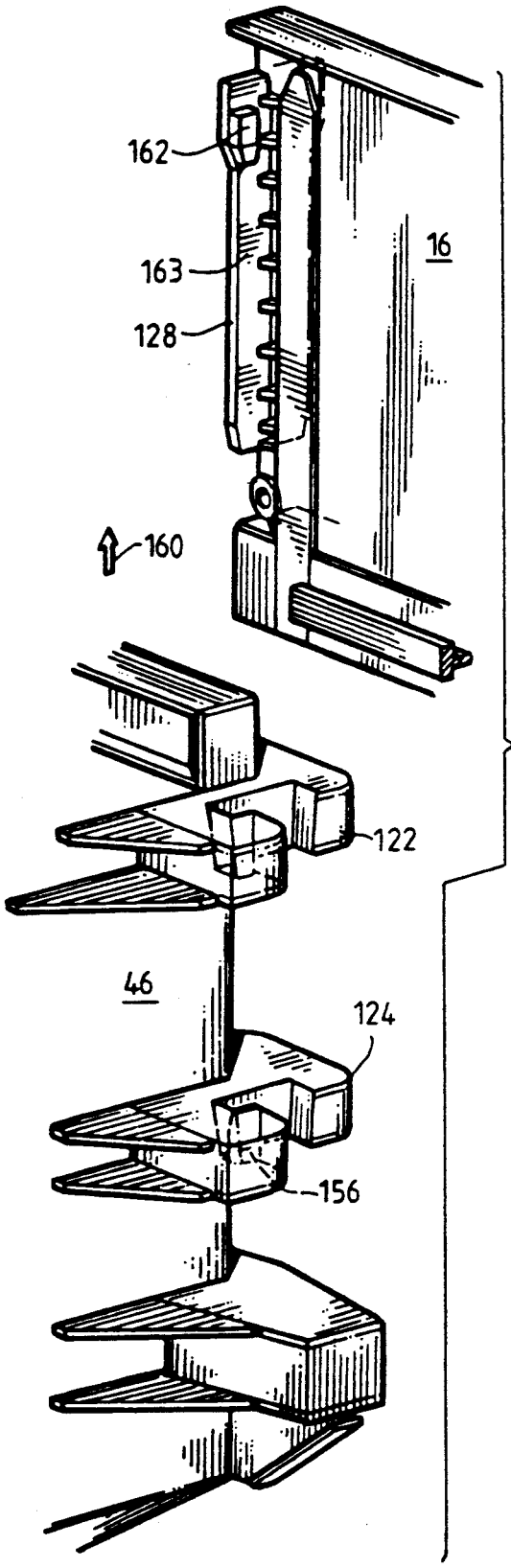
FIG. 17 illustrates an exploded perspective view of the blade member and guide assembly of the lock.
Figure 18:
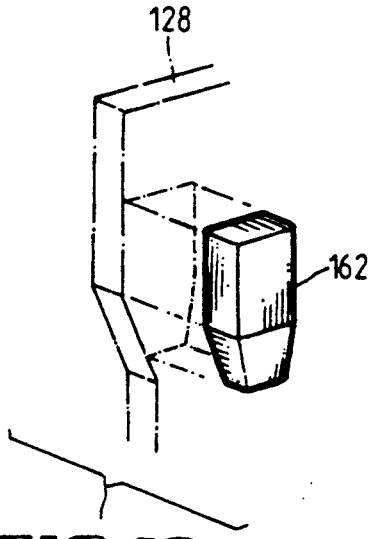
FIG. 18 illustrates an exploded perspective view of an upper rear face of the blade member, including a cam surface.
Figure 19:
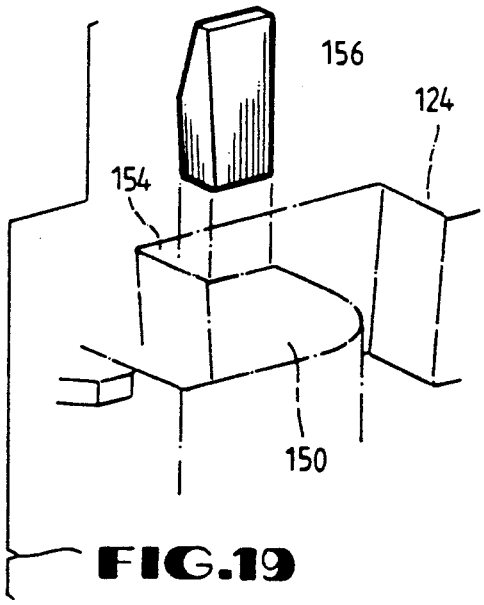
FIG. 19 illustrates an exploded perspective view of the lower guide member, including a cam surface.

A better appreciation of the operation of the cam surfaces may be had by reference to FIG. 17–19. FIG. 17 illustrates a perspective view of one side of the transom 46 positioned vertically below the skidbase 16 and generally aligned therewith so that upward movement of the transom 46, as indicated by the arrow 160, causes the guide members 122, 124 to engage the blade member 128. The cam surface 156 associated with the lower guide member 124 is illustrated in phantom lines. A second cam surface 162 associated with the upper guide assembly 122 is shown attached to a rear surface 163 of the blade member 128.

The cam surfaces 162, 156 are illustrated in greater detail in FIGS. 18 and 19, respectively. The cam surfaces 156, 162 have at least one tapered surface thereon so that when the blade member 128 is engaged by the guide members 122, 124, the cam surfaces 156, 162 progressively urge the blade member 128 (and hence the skidbase 16) into precise alignment with the transom 46. One advantage in attaching the cam surface 156 to the lower guide member 124 while attaching the cam surface 162 to the blade member 128 is to allow the lower section 136 of the blade member 128 to freely pass through the upper guide member 122 without contact between a cam surface and the blade member 128. Rather, the cam action for precise alignment occurs when the transom 46 is near its extreme upward vertical position. In this manner, horizontal movement of the skidbase 16 occurs at the end of the vertical positioning step. It should be appreciated that if the cam surface 162 was attached to the arm 148, then the lower section 136 of the blade member 128 would engage the cam surface 162 during its movement through the upper guide assembly 122.

While the blade member 128 and guide assembly 121 have been described in the singular form, it should be appreciated that operation of the lock 120 may be improved by the use of two spaced-apart assemblies. Preferably, a pair of blade members 128 are mounted on the beams 52, 54 and interact with two sets of guide assemblies 121 and stops 126 located on the transom 46 of the jack-up platform 12.

With the arrangement of the above-described components, a stagewise alignment ca be achieved between the skidbase 16 and the jack-up platform 12. As the jack-up platform 12 is raised, the upper guide member 122 first encounters the lower section 136 of the blade member 128. The tapered initial section 129 of the blade member 128 is guided into a relatively rough alignment with the tapered lateral movement limiting shoulders 140, 142 of the upper guide member 122. This relatively rough alignment situates the blade member 128 to encounter the lower guide member 124. When the lower guide member 124 engages the lower section 136 of the blade member 128, a finer alignment is achieved as the tapered lateral movement limiting shoulders 144, 146 cam the lower section 136 of the blade member 128 into position. At the same time that the lower guide member 124 is camming the lower section 136 of the blade member 128, the upper section 134 of the blade member 128 is engaging the upper guide member lateral movement limiting shoulders 140, 142 to enhance the camming action on the blade member 128 and provide a progressive, fine alignment of the blade member 128. Finally, a still yet finer alignment of the skidbase 16 and the jack-up platform 12 is achieved by the action of the upper and lower cam surfaces 162, 156.

The upper cam surface 162 urges the blade member 128 toward the base 152 of the upper guide member 122, and the lower cam surface 156 urges the blade member 128 toward the base 154 of the lower guide member 124. The upper and lower lateral movement limiting shoulders 140–144 with their tapered surfaces, and the upper and lower cam surfaces 162, 156 with their tapered surfaces coact with the stop member 126 to precisely and finely align the skidbase 16 with the jack-up platform 12 to position their respective skid rails 44, 32 adjacent each other for an advantageous transfer of the drilling structure 18 from the jack-up platform 12 to the fixed platform 14 and the back again. A surprisingly high degree of precision is achievable without the use of pins or mechanical devices in the practice of this invention.

We claim:

1. A skidbase locking apparatus for locking a skidbase to a structure, comprising:

a skidbase having a pair of skid rails mounted on an upper surface thereof and a rear surface positioned adjacent said structure; and a lock comprising, a blade member attached to said skidbase rear surface, said blade member having a substantially front face, an upper section having a first width, and a lower section having a second width, said first width being greater than said second width;

a guide assembly attached to said structure and cooperative with said blade member, said guide assembly having an upper guide member and a lower guide member, said upper guide member and said lower guide member each having a base, a pair of spaced apart lateral movement limiting shoulders connected to said base and defining a width therebetween, and a longitudinal movement limiting arm spaced from said base and defining a depth therebetween, the upper guide member width and the upper guide member depth being greater than the corresponding lower guide member width and lower guide member depth respectively; and a stop adapted to limit the vertical movement of said blade member relative to said guide assembly, said stop being operable to support a load placed on said skid rails said lock being operable in response to relative movement between said blade member and said guide assembly with said upper section of said blade member being positioned in contact with said upper guide member and said lower section of said blade member being positioned in contact with said lower guide member to lock said skidbase to said structure.

2. A skidbase locking apparatus, as set forth in claim 1, wherein said blade member includes an intermediate section positioned between said upper and lower sections having a width that tapers from said first width adjacent said upper section to said second width adjacent said lower section.

3. A skidbase locking apparatus, as set forth in claim 1, wherein said blade member includes a distal section positioned adjacent said lower section and spaced from said upper section, said distal section having a width that tapers from said second width adjacent said lower section to a third width immediately adjacent a distal end of said blade member.

4. A skidbase locking apparatus, as set forth in claim 1, wherein said upper guide member width tapers in a direction from an upper surface to a lower surface of said upper guide member.

5. A skidbase locking apparatus, as set forth in claim 4, wherein said lower guide member width tapers in a direction from an upper surface to a lower surface of said lower guide member.

6. A skidbase locking apparatus, as set forth in claim 1, wherein said blade member includes a rear face positioned opposite said front face, and a cam surface connected to said rear face, said cam surface being adapted to cooperate with said longitudinal movement limiting arm to urge said blade member in a direction toward said structure.

7. A skidbase locking apparatus, as set forth in claim 1, wherein said lower guide member longitudinal movement limiting arm includes a front surface generally facing said base, and a cam surface connected to said front surface, said cam surface being adapted to cooperate with said blade member to urge said blade member in a direction toward said structure.

8. A skidbase locking apparatus for locking a skidbase to a structure comprising:

a skidbase comprising, a left beam assembly having a skid rail on an upper surface thereof, a right beam assembly having a skid rail on an upper surface thereof, connecting members adapted for connecting said left and said right beam assemblies, a lock comprising, a left blade member attached to said left beam assembly and a right blade member attached to said right beam assembly, each of said blade members having a substantially front face, an upper section having a first width, and a lower section having a second width, said first width being greater than said second width, a left and a right guide assembly attachable to said structure and cooperative with said left and right blade members respectively, each of said guide assemblies comprising, an upper guide member and a lower guide member, said upper guide member and said lower guide member each having a base, a plurality of spaced apart lateral movement limiting shoulders connected to said base and defining a width therebetween, and a longitudinal movement limiting arm spaced from said base and defining a depth therebetween, the upper guide member width and the upper guide member depth being greater than the corresponding lower guide member width and lower guide member depth respectively, a left stop and a right stop adapted to limit the vertical movement of said left and said right blade members relative to said left and said right guide assemblies, said stops being operable to support a load placed on said skid rails, said lock being operable in response to said left and said right blade members being inserted into said left and said right guide assemblies respectively with said left and right upper sections of said blade members positioned in contact with said left and right upper guide members and said left and right lower sections of said blade members positioned in contact with said left and right lower guide members to lock said skidbase to said structure.

9. A skidbase locking apparatus, as set forth in claim 8, wherein said blade members include an intermediate section positioned between said upper and lower sections having a width that tapers from said first width adjacent said upper section to said second width adjacent said lower section.

10. A skidbase locking apparatus, as set forth in claim 8, wherein each of said blade members includes a distal section positioned adjacent said lower section and spaced from said upper section, said distal section having a width that tapers from said second width adjacent said lower section to a third width immediately adjacent a distal end of said blade member.

11. A skidbase locking apparatus, as set forth in claim 8, wherein each of said upper guide members width tapers in a direction from an upper surface to a lower surface of said upper guide member.

12. A skidbase locking apparatus, as set forth in claim 11, wherein each of said lower guide members width tapers in a direction from an upper surface to a lower surface of said lower guide member.

13. A skidbase locking apparatus, as set forth in claim 8, wherein said blade members each include a rear face positioned opposite said front face, and a cam surface connected to said rear face, said cam surface being adapted to cooperate with said longitudinal movement limiting arm to urge said blade member in a direction toward said structure.

14. A skidbase locking apparatus, as set forth in claim 8, wherein each of said lower guide member longitudinal movement limiting arms includes a front surface generally facing said base, and a cam surface connected to said front surface, said cam surface being adapted to cooperate with said blade member to urge said blade member in a direction toward said structure.

15. An apparatus for transferring a drilling structure from a movable platform along a pair of skid rails on said movable platform to a skidbase positioned on a fixed platform, comprising:

said skidbase being movable relative to said fixed platform and having a left and right beam assembly and connecting members adapted for connecting said left and said right beam assemblies together, each of said beam assemblies having a skid rail on an upper surface thereof adapted for receiving said drilling structure thereon;

a lock adapted for connecting said skidbase to said movable platform, comprising:

a left and right blade member respectively attached to said left and right beam assembly, each of said blade members having a front surface, an upper section having a first width, and a lower section having a second width, said first width being greater than said second width;

a left and a right guide assembly attachable to said movable platform and cooperative with said left and right blade members respectively, each of said guide assemblies comprising:

an upper guide member and a lower guide member, said upper guide member and said lower guide member each having a base connected to said movable platform, a plurality of spaced apart lateral movement limiting shoulders connected to said base and defining a width therebetween, and a longitudinal movement limiting arm connected to one of said lateral movement limiting shoulders and spaced from said base and defining a depth therebetween; and the upper guide member width and the upper guide member depth being greater than the corresponding lower guide member width and lower guide member depth respectively;

a left stop and a right stop positioned below said upper and lower guide members, said stops being adapted to limit the vertical movement of said left and said right blade members relative to said left and said right guide assemblies, said stops being operable to support a load placed on said skid rails on said skidbase;

said lock being operable in response to said movable platform being raised vertically so that said left and said right blade members contact and ar inserted into said left and said right guide assemblies respectively with said left and right upper sections of said blade members positioned in contact with said left and right upper guide members and said left and right lower sections of said blade members positioned in contact with said left and right lower guide members to lock said skidbase to said movable platform, said skidbase being movable in response to contact between said blade members and said guide members to align said blade members with said guide members; and power means for urging said drilling structure from said movable platform onto said skidbase on said skid rails.

16. An apparatus, as set forth in claim 15, wherein said blade members include an intermediate section positioned between said upper and lower sections having a width that tapers from said first width adjacent said upper section to said second width adjacent said lower section.

17. An apparatus, as set forth in claim 15, wherein each of said blade members includes a distal section positioned adjacent said lower section and spaced from said upper section, said distal section having a width that tapers from said second width adjacent said lower section to a third width immediately adjacent a distal end of said blade member.

18. An apparatus, as set forth in claim 15, wherein each of said upper guide members width tapers in a direction from a upper surface to a lower surface of said upper guide member.

19. An apparatus, as set forth in claim 18, wherein each of said lower guide members width tapers in a direction from an upper surface to a lower surface of said lower guide member.

20. An apparatus, as set forth in claim 15, wherein said blade members each include a rear face positioned opposite said front face, and a cam surface connected to said rear face, said cam surface being adapted to cooperate with said longitudinal movement limiting arm to urge said blade member in a direction toward said structure.

21. An apparatus, as set forth in claim 15, wherein each of said lower guide member longitudinal movement limiting arms includes a front surface generally facing said base, and a cam surface connected to said front surface, said cam surface being adapted to cooperate with said blade member to urge said blade member in a direction toward said structure.

22. A method of transferring a drilling structure from a deck of a jack-up platform to a skidbase positioned on a deck of a fixed platform comprising the steps of:

positioning the jack-up platform adjacent the fixed platform, positioning the deck of the jack-up platform at about the same vertical height as a deck on the fixed platform, transferring the skidbase from the deck of the jack-up platform onto the deck of the fixed platform, raising the vertical height of the jack-up platform while maintaining the vertical height of the skidbase to displace upwardly a set of spaced apart, plural staged guide assemblies on the jack-up platform over and into engagement with a corresponding set of spaced apart, plural staged blade members on the skidbase to simultaneously cam the skidbase into longitudinal alignment with the jack-up platform, position the height of the jack-up structure in relation to the skidbase to receive the drilling structure, and lock together the skidbase to the jack-up platform to minimize relative movement therebetween, transferring the drilling structure from the jack-up rig to the fixed platform, and lowering the level of the jack-up platform while maintaining the level of the fixed platform to displace downwardly the set of guide assemblies to simultaneously unlock and disengage the guide assemblies from the blade members on the skidbase.

23. A skidbase locking apparatus for locking a skidbase to a structure, comprising:

a skidbase having a pair of skid rails mounted on an upper surface thereof and a rear surface positioned adjacent said structure; and a lock comprising, a blade member attached to said skidbase rear surface, said blade member having a substantially front face, an upper section having a first width, and a lower section having a second width, said first width being greater than said second width; and a guide assembly attached to said structure and cooperative with said blade member, said guide assembly having a first guide member having a base and a pair of spaced apart lateral movement limiting shoulders connected to said base and defining a width therebetween;

said lock being operable in response to relative movement between said blade member and said guide assembly with said upper section of said blade member being positioned in contact with said first guide member to lock said skidbase to said structure.

24. A skidbase locking apparatus, as set forth in claim 23, wherein said guide assembly includes a second guide member positioned vertically below said first guide member, and having a base and a pair of spaced apart lateral movement limiting shoulders connected to said base and defining a width therebetween, the width between said shoulders of said first guide member being greater than the width between the shoulders of said second guide member, said lock being operable in response to relative movement between said blade member and said guide assembly with said upper section of said blade member being positioned in contact with said first guide member and said lower section of said blade member being positioned in contact with said second guide member to lock said skidbase to said structure.

25. A skidbase locking apparatus as set forth in claim 23, wherein a stop coupled to said structure and adapted to limit the vertical movement of said blade member relative to said guide assembly, said stop being operable to support a load placed on said skid rails.

26. A skidbase locking apparatus as set forth in claim 24, wherein said first guide member includes a longitudinal movement limiting arm spaced from said base and defining a depth therebetween, and said blade member includes a rear face positioned opposite said front face, and a cam surface connected to said rear face, said cam surface being adapted to cooperate with said longitudinal movement limiting arm to urge said blade member in a direction toward said structure.

27. A skidbase locking apparatus as set forth in claim 26, wherein said second guide member includes a longitudinal movement limiting arm spaced from said base and defining a depth therebetween, the first guide member depth being greater than the second guide member depth.

* * * * *